United States Patent [19]

Cappotto

[11] Patent Number: 4,886,385

[45] Date of Patent: Dec. 12, 1989

[54] RIBBON TENSIONING MECHANISM

[75] Inventor: Samuel D. Cappotto, Syracuse, N.Y.

[73] Assignee: Smith Corona Corporation, Cortland, N.Y.

[21] Appl. No.: 211,936

[22] Filed: Jun. 27, 1988

[51] Int. Cl.[4] ..... B41J 33/52

[52] U.S. Cl. ..... 400/234; 242/75.43

[58] Field of Search ..... 400/234, 236.1, 235, 400/235.1, 236, 236.2, 697.1; 242/75, 75.4, 75.43, 194

[56] References Cited

U.S. PATENT DOCUMENTS

| | | | |
|---|---|---|---|
| 2,199,291 | 4/1940 | O'Halloran et al. | 400/234 |
| 2,202,958 | 6/1940 | McFarland | 400/234 |
| 2,278,009 | 3/1942 | Handley | 400/234 |
| 3,062,350 | 11/1962 | Demmel | 400/370 |
| 3,904,016 | 9/1975 | Hengelhaupt | 400/234 |
| 4,074,799 | 2/1978 | Hishida et al. | 400/234 |
| 4,273,454 | 6/1981 | Anagnostopolous | 400/234 |
| 4,605,327 | 8/1986 | Ueki et al. | 400/234 |
| 4,710,044 | 12/1987 | Ackermann | 400/234 |
| 4,747,716 | 5/1988 | van der Eikel | 400/234 |
| 4,790,677 | 12/1988 | Kress | 400/234 |

FOREIGN PATENT DOCUMENTS

| | | | |
|---|---|---|---|
| 70686 | 5/1982 | Japan | 400/234 |
| 124280 | 7/1985 | Japan | 400/23 X |
| 160275 | 7/1986 | Japan | 400/234 |
| 162581 | 7/1987 | Japan | 400/23 X |

*Primary Examiner*—David A. Wiecking

[57] ABSTRACT

A ribbon or tape tensioning system for typewriter correction ribbons includes a brake for exerting a braking force on a supply or feed ribbon spool. The mounting capstan for the feed spool is provided with a toothed hub which can be engaged by a pawl rotatably mounted on an arm which in turn is rotatably mounted on the typewriter frame. The pawl and the arm are provided with abutments or projections which when brought into contact with the frame cause the pawl to disengage or engage the toothed hub, thus permitting the hub to rotate freely or be braked. A force applied by an element such as a spring biases the assembly in a direction to cause the capstan to exert a tension on the ribbon, except when the pawl is disengaged. When the tension on the ribbon exceeds a predetermined amount, the pawl is disengaged from the toothed hub, permitting its momentary rotation and relief of the tension.

7 Claims, 2 Drawing Sheets

RIBBON TENSIONING MECHANISM

FIELD OF THE INVENTION

This invention relates to ribbon tensioning mechanisms, and particularly to ribbon tensioning mechanisms for use with a ribbon cassette as used in typewriters. More particularly, the present invention relates to a correction ribbon tensioning mechanism for use in a typewriter having a ribbon type of error correction mechanism.

BACKGROUND OF THE INVENTION

A prominent feature of modern typewriters is an error correction feature in which tapes or ribbons are struck with the erroneous letter or letters, and the errors are either covered up or are lifted from the paper. The correction ribbons are "one-time" products, good for one erasure per character space, and fresh ribbon must be supplied as needed for erasing operation. Accordingly, cassette arrangements are provided for such correction ribbons and require ribbon tensioning mechanisms for maintaining a substantially constant tension of the ribbon to prevent the ribbon from drooping and interfering with the printing mechanism and/or printing ribbon of the typewriter.

The prior art is replete with ribbon tensioning mechanisms, such as, for example, U.S. Pat. Nos. 2,202,958; 4,273,454 and 4,605,327. However, the known mechanisms require a multiplicity of parts, or are delicate, or require adjustments or are difficult to assemble.

OBJECTS OF THE INVENTION

Accordingly,it is a principal object of this invention to provide an improved ribbon tensioning mechanism.

Another object of the invention is to provide an improved ribbon tensioning mechanism especially suited for use with a correction ribbon cassette.

Still another object of the invention is to provide an improved ribbon tensioning mechanism having only a few parts, providing an economical mechanism which provides ease of assembly and requires no adjustments by the installer or operator.

Yet another object of the invention is to provide an improved ribbon tensioning mechanism which provides a substantially constant tension to a typewriter correction ribbon contained in a cassette.

SUMMARY OF THE INVENTION

The present invention comprises a ribbon feed or supply spool mounting capstan, having a toothed hub which can be engaged by a pawl, the pawl being mounted for rotation on a pivoted arm so that it can be swung into and out of engagement with the toothed hub. A single tension coil spring biases the pawl and the pivoted arm into an operative position, in which abutments or projections on the pawl and the arm cause the pawl to disengage or engage the toothed hub, thereby providing a braking action on the feed spool and resulting tension on the ribbon. When the tension increases beyond a predetermined amount the pawl is momentarily disengaged from the toothed hub, to thereby reduce the tension by a small amount.

BRIEF DESCRIPTION OF THE DRAWINGS

Other objects of the invention and features of novelty will be apparent from the following detailed description of a preferred embodiment of the invention, taken in connection with the accompanying drawings, in which.

Similar reference characters refer to similar parts in each of the several views.

DETAILED DESCRIPTION OF A PREFERRED EMBODIMENT

Figure 1:
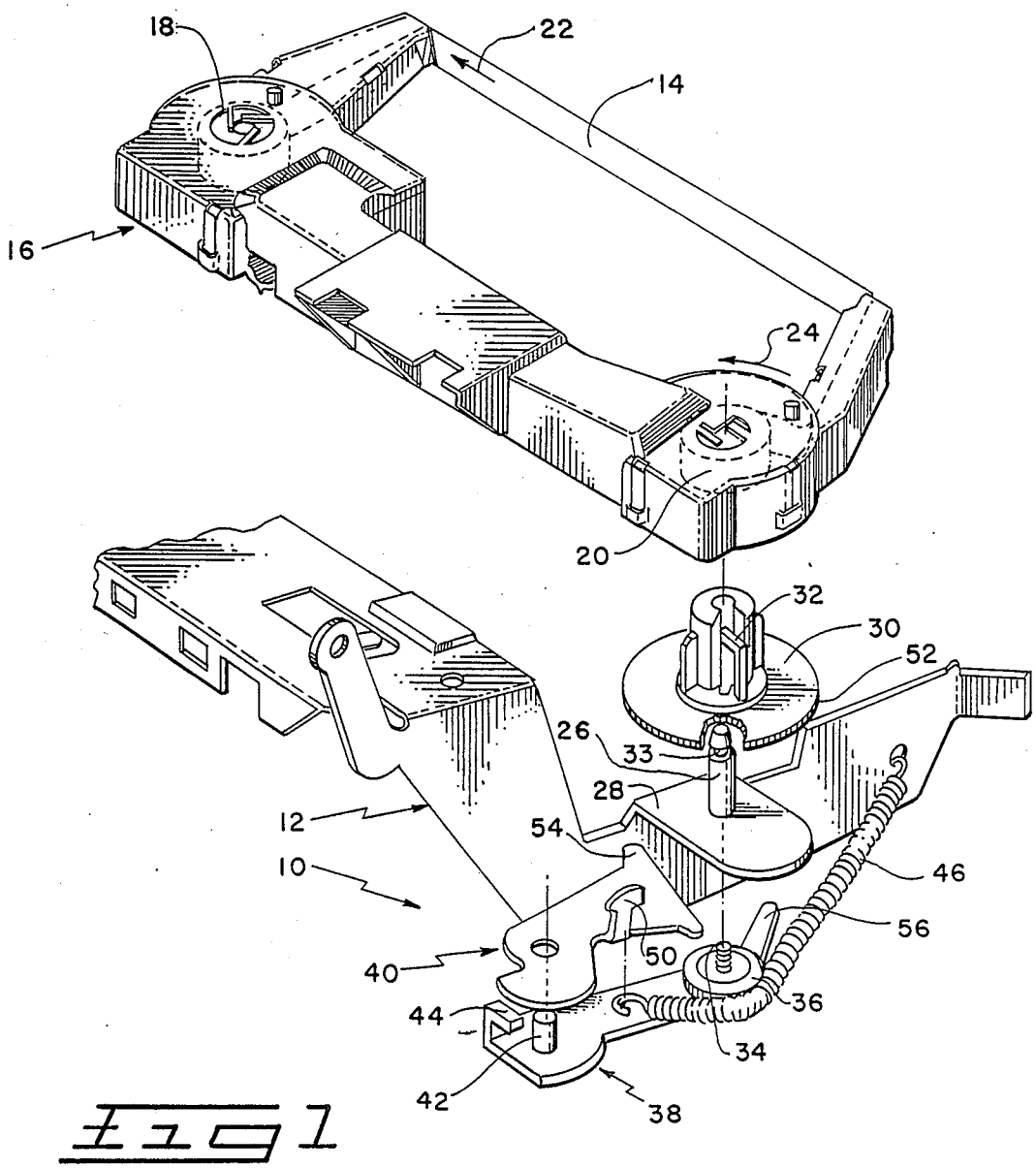
FIG. 1 is a general schematic view of a ribbon tensioning mechanism in accordance with a preferred embodiment of the invention.

A correction tape tension mechanism 10 (FIG. 1) is mounted on a frame 12 in a typewriter. The mechanism 10 maintains a predetermined amount of tension on an error correction tape 14 mounted in a tape cassette 16 during typing operations and when the typewriter is not in use.

The cassette 16 is mounted on the frame 12. A take-up spool 18 and a supply spool 20 are rotatably mounted in the cassette 16. A tape feed mechanism (not shown) drives the take-up spool 18 for incrementally feeding the tape 14 in the direction of an arrow 22. The mechanism 10 biases the supply spool 20 in the direction of an arrow 24. Since the arrows 22 and 24 pull on the tape 14 in opposite directions, the tape 14 is slightly tensioned.

Figure 2:
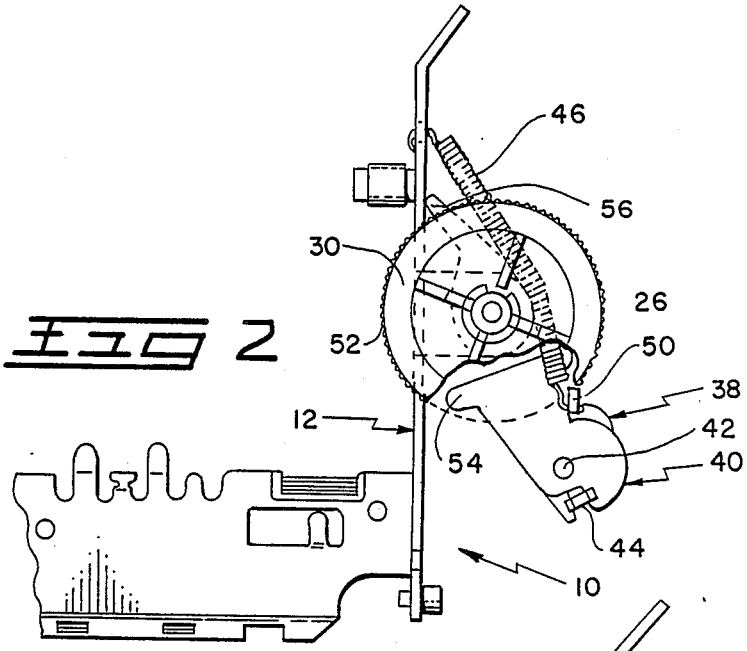
FIG. 2 is a schematic plan view of a portion of the assembly shown in FIG. 1, in which the tension is being exerted on the ribbon.

The mechanism 10 includes a shaft 26 mounted on a support 28 formed from the frame 12. A toothed hub 30 is rotatably mounted on the shaft 26 and retained by a flexible finger 32 seating in a groove 33 in the shaft 26. A shouldered screw 34 extends through a hub 36 integrally formed from an arm 38 and is threaded into the shaft 26 for mounting the arm 38 on the support 28. A pawl 40 is pivotably mounted on the arm 38 by a pin 42 integrally formed from the arm 38 and by a retainer finger 44. A coil spring 46 is connected at one end to the pawl 40 and at the other end to the frame 12. The spring 46 is biased against the hub 36 in such a manner to simultaneously bias the pawl 40 counterclockwise about the pin 42 and bias arm 38 counterclockwise about the shaft 26. The pawl 40 has a tooth 50 biased into engagement with teeth 52 on the hub 30 by the spring 46 (FIG. 2). The pawl 40 also has an abutment 54 for engaging the frame 12 when the tape 14 is sufficiently tensioned. The arm 38 also has an abutment 56 for engaging the frame 12 when the tape is sufficiently loose (FIG. 2).

The operation of the mechanism 10 will now be described. When the cassette 16 is installed in the typewriter, the tape 14 will be incrementally fed in the direction of the arrow 22 by a tape feed mechanism (not shown). The supply spool 20 is rotated clockwise by the tape 14. The hub 30 is rotated clockwise by the supply spool 20.

The arm 38 is rotated clockwise by the tooth 50 and the teeth 52 driving the pawl 40. Tension is added to the spring 46 as the arm 38 rotates clockwise. The added tension on the spring 46 tends to rotate the arm 38 counterclockwise which, in turn, tends to rotate the hub 30 counterclockwise by the pawl 40. The hub 30 tends to rotate the supply spool 20 counterclockwise which pulls the tape 14 in the direction of the arrow 24. In this manner, a slight tension will be maintained on the tape 14 during normal tape feeding and when the typewriter is not in use.

To prevent the tape 14 from becoming more tensioned than needed, which would require additional force from the tape feed mechanism to feed the tape, the mechanism 10 includes a positive tape release feature.

During normal typing, the arm 38 is rotated clockwise by the rotating hub 30 until the abutment 54 of the pawl 40 contacts the frame 12. A slight additional pull on the tape 14 by the typing operation will rotate the arm 38 clockwise sufficiently to cause the abutment 54 to pivot the pawl 40 clockwise.

Figure 3:
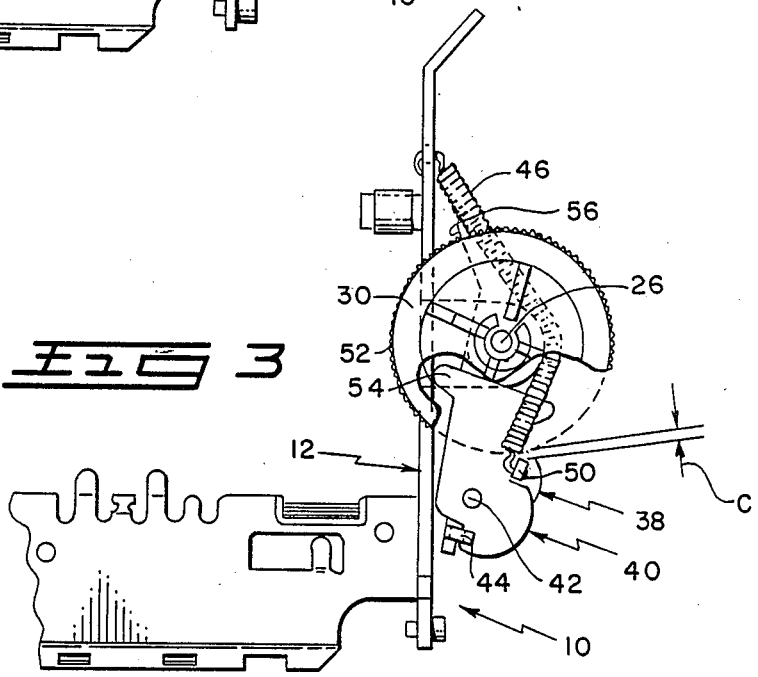
FIG. 3 is a schematic plan view of the assembly of FIG. 1, illustrating the condition in which the tape has been released to unwind a small amount from the supply or feed spool without tension.

The clockwise movement of the pawl 40 disengages the tooth 50 from the teeth 52 on the hub 30 (FIG. 3) shown by arrows C. At this time, the hub 30 is free to rotate clockwise to allow the tape 14 to unwind from the supply spool 20 with minimum resistance. The tension on the tape 14 is released when some tape 14 has unwound from the supply spool 20.

The disengagement of the tooth 50 from the teeth 52 provides a positive release of the tension mechanism 10 from the tape 14. When the tension on the tape 14 is released, the spring 46 biases the arm 38 counterclockwise sufficiently to move the abutment 54 away from the frame 12. The same bias of the spring 46 quickly biases the tooth 50 back into enagement with the teeth 52.

Repeated disengagement of the tooth 50 from the teeth 52 by the abutment 54 pivoting the pawl 40 clockwise and the re-engagement of the tooth 50 with the teeth 52 by the spring 46 maintains a predetermined amount of tension on the tape 14 while requiring minimum feeding force from the tape feed mechanism which provides an efficient tape feed and tension system.

From all of the foregoing, it will be apparent that the present invention provides a new and improved ribbon tensioning mechanism characterized by simplicity of structure, economy of manufacture and ease of assembly, while providing a predetermined degree of tension in a ribbon or tape, requiring a minimum feeding force from the feed mechanism, resulting in an efficient tape feed and tension system.

Although there has herein been shown and described only a single preferred embodiment of the invention, it will be apparent to those skilled in the art that various changes and modifications may be made therein, within the scope of the appended claims, without deparating from the spirit and scope of the invention.

Having thus described the invention, what is claimed is:

1. A ribbon tensioning mechanism comprising, in combination:

a frame;

a supply spool carrying a roll of ribbon;

ribbon take up spooling means for exerting tension on the ribbon in a first direction to unwind the ribbon from said supply spool;

a shaft mounted on said frame;

a toothed hub rotatably mounted on said shaft, said supply spool mounted on said toothed hub for rotation therewith;

an operating arm mounted on said shaft for rotation coaxially with the said toothed hub;

a pawl rotatably mounted on said arm, remote from the said supply shaft axis, said pawl having a pawl tooth for engaging the teeth on said toothed hub;

biasing means for biasing said arm and said pawl tooth into engagement with the teeth on said toothed hub and for causing the pawl to bias said toothed hub and said supply spool about said shaft for exerting and maintaining tension on the ribbon in a second direction opposite from said first direction;

disengaging means for positively disengaging said pawl tooth from said toothed hub, including rotation of said operating arm about said ribbon supply shaft axis which causes subsequent rotation of said pawl and pawl tooth about a fixed point axis on the operating arm, distinct from said supply shaft axis, which thus removes the tension from said toothed hub and the ribbon in said second direction in response to tension on the ribbon in said first direction to allow said supply to unwind with minimum resistance to reduce ribbon tension; and said biasing means operatively connected to said disengaging means for re-engaging said pawl tooth with said toothed hub in response to said disengagement of said pawl tooth from said toothed hub for maintaining tension on the ribbon in said second direction.

2. The ribbon tensioning mechanism as claimed in claim 1 wherein said biasing means includes spring means operatively connected to said pawl and said arm.

3. The ribbon tensioning mechanism as claimed in claim 2 wherein said spring means comprising at least one coil spring.

4. The tensioning mechanism as claimed in claim 3 wherein said coil spring having a first end connected to said frame and a second end connected to said pawl to exert tension on said pawl effective to engage said pawl tooth with said toothed hub.

5. A ribbon tensioning mechanism as claimed in claim 1, further characterized by said disengaging means comprising a projection on said pawl which contacts said frame and rotates the pawl on an axis located on the operating arm distinct from said supply spool axis, to thereby disengage said pawl tooth from said toothed hub.

6. The tensioning mechanism as claimed in claim 5 wherein said biasing means being effective to bias said pawl away from said frame when said pawl tooth is disengaged from said toothed hub and thereafter being effective to bias said pawl tooth back into engagement with said toothed hub for again exerting tension on the ribbon in said second direction.

7. The ribbon tensioning mechanism as claimed in claim 1 wherein said arm having an abutment for engaging said frame to limit the rotation of said arm by said biasing means for limiting the tension exerted on the ribbon in said second direction.

* * * * *